US007946110B2

(12) United States Patent
Colignon

(10) Patent No.: US 7,946,110 B2
(45) Date of Patent: May 24, 2011

(54) SYSTEM FOR ASSISTING THE REGENERATION OF DEPOLLUTION MEANS INCLUDED IN A MOTOR VEHICLE EXHAUST LINE

(75) Inventor: Christophe Colignon, Levallois Perret (FR)

(73) Assignee: Peugeot Citroen Automobiles SA, Velizy Villacoublay (FR)

( * ) Notice: Subject to any disclaimer, the term of this patent is extended or adjusted under 35 U.S.C. 154(b) by 0 days.

(21) Appl. No.: 10/595,824

(22) PCT Filed: Oct. 7, 2004

(86) PCT No.: PCT/FR2004/002532

§ 371 (c)(1),
(2), (4) Date: May 15, 2006

(87) PCT Pub. No.: WO2005/064141

PCT Pub. Date: Jul. 14, 2005

(65) Prior Publication Data

US 2007/0144148 A1 Jun. 28, 2007

(30) Foreign Application Priority Data

Nov. 25, 2003 (FR) ..... 03 13828

(51) Int. Cl.
*F01N 3/00* (2006.01)

(52) U.S. Cl. ..... 60/295; 60/274; 60/285; 60/297

(58) Field of Classification Search ..... 60/280, 60/285, 295, 297, 311; 44/358, 359, 363, 44/366

See application file for complete search history.

(56) References Cited

U.S. PATENT DOCUMENTS

| | | | | |
|---|---|---|---|---|
| 4,655,037 | A * | 4/1987 | Rao | 60/274 |
| 5,287,698 | A * | 2/1994 | Shinzawa et al. | 60/286 |
| 6,237,326 | B1 * | 5/2001 | Russell | 60/274 |
| 6,490,857 | B2 * | 12/2002 | Sasaki | 60/278 |
| 6,708,487 | B2 * | 3/2004 | Morimoto et al. | 60/311 |
| 6,751,949 | B2 * | 6/2004 | Tamura et al. | 60/284 |
| 6,769,245 | B2 * | 8/2004 | Itoh et al. | 60/295 |

(Continued)

FOREIGN PATENT DOCUMENTS

| | | | |
|---|---|---|---|
| EP | 0859132 | A | 8/1998 |
| EP | 1203876 | A | 5/2002 |
| EP | 1321642 | A | 6/2003 |
| WO | WO 0226379 | A | 4/2002 |
| WO | WO 02075138 | A | 9/2002 |

OTHER PUBLICATIONS

"Diesel fuel regeneration", Dieselnet Technology Guide, Jul. 2001 (XP002190323).

(Continued)

*Primary Examiner* — Tu M Nguyen
(74) *Attorney, Agent, or Firm* — Nicolas E. Seckel

(57) ABSTRACT

In a system for assisting the regeneration of depollution apparatus associated with an oxidation catalyst implementing an OSC function, constituting a supply of oxygen and integrated in an exhaust line of a motor vehicle diesel engine, in which the engine is associated with a common rail for feeding its cylinders with fuel, the running conditions of the vehicle are analyzed and compared with predetermined threshold values, to control the engine in a first regeneration mode of operation with a lean mixture when running conditions are above the threshold values, or in a second regeneration operating mode implementing sequences in which engine operation alternates between stages of rich mixture operation and of lean mixture operation when conditions are below the threshold values.

20 Claims, 2 Drawing Sheets

U.S. PATENT DOCUMENTS

Figure 1:
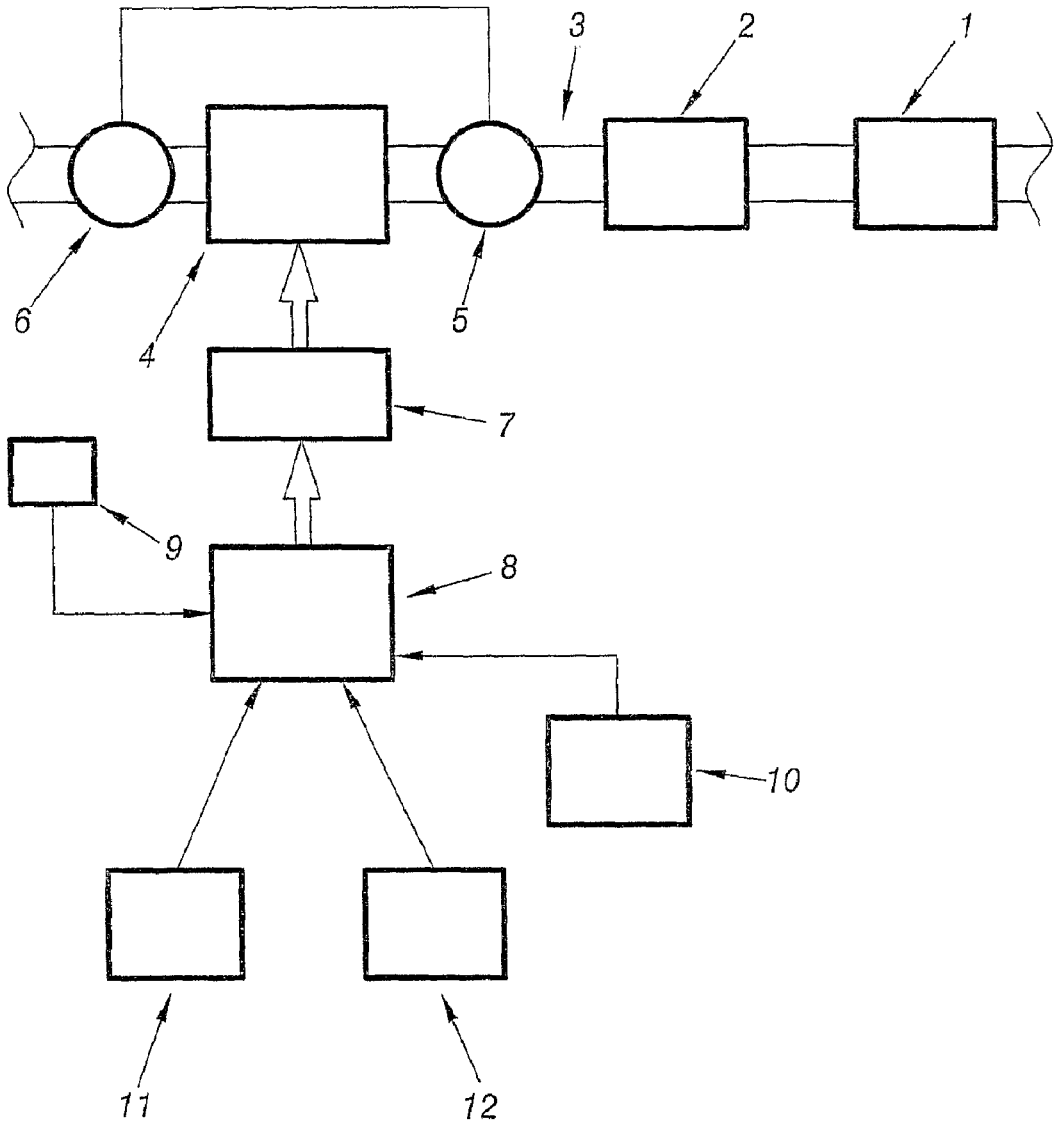

| | | | | |
|---|---|---|---|---|
| 6,931,842 | B2 * | 8/2005 | Ohtake et al. | 60/295 |
| 6,952,919 | B2 * | 10/2005 | Otake et al. | 60/297 |
| 7,017,337 | B2 * | 3/2006 | Plote et al. | 60/295 |
| 7,062,906 | B2 * | 6/2006 | Otake et al. | 60/295 |
| 7,137,247 | B2 * | 11/2006 | Koga et al. | 60/295 |
| 7,146,804 | B2 * | 12/2006 | Yahata et al. | 60/295 |
| 7,200,991 | B2 * | 4/2007 | Otake et al. | 60/311 |
| 2002/0007629 | A1 * | 1/2002 | Asanuma et al. | 60/297 |
| 2003/0046929 | A1 * | 3/2003 | Terada et al. | 60/286 |

OTHER PUBLICATIONS

Bunting, "Springing the Trap", Automotive Engineer, Mechanical Engineering Publ. Ltd., Bury St. Edmunds, UK, vol. 25, No. 5, May 2000 (XP000936087).

International Search Report dated Mar. 3, 2005.

* cited by examiner

SYSTEM FOR ASSISTING THE REGENERATION OF DEPOLLUTION MEANS INCLUDED IN A MOTOR VEHICLE EXHAUST LINE

The present invention relates to a system for assisting the regeneration of depollution means associated with oxidation catalyst-forming means implementing an oxygen storage capacity (OSC) function constituting a supply of oxygen and in an exhaust line of a motor vehicle diesel engine.

More particularly, the invention relates to such a system which the engine is associated with common manifold or "rail" means for feeding its cylinders with fuel.

In order to regenerate depollution means such as a particle filter, the soot trapped therein is burned using heat delivered by the engine and the exothermal reaction achieved by converting hydrocarbons (HCs) on the oxidation catalyst-forming means placed upstream from the particle filter.

This combustion can be assisted by a catalyst element mixed with the soot, e.g. coming from an additive for assisting regeneration that is mixed with the fuel fed the engine, or by a catalyst that is deposited directly on the walls of the particle filter (catalyst-containing particle filter).

The higher the temperature levels in the exhaust line at the inlet to the particle filter, the shorter the length of time required for regenerating the filter.

Unfortunately, under critical running conditions, e.g. in a built-up area or a traffic jam, the temperature levels reached using conventional strategies for assisting regeneration of the particle filter can be insufficient for ensuring proper regeneration of the filter, and this can lead to regeneration being very lengthy, thereby consuming a large amount of fuel, or else to regeneration that is not complete.

Any strategy for raising the temperature levels during such critical running periods then makes it possible to ensure that regeneration is complete, to reduce the extra consumption of fuel due to such regeneration of the particle filter, and above all to increase the safety margin with respect to the filter cracking or breaking.

The object of the invention is to provide such a strategy.

To this end, the invention provides a system for assisting the regeneration of depollution means associated with oxidation catalyst-forming means implementing an OSC function, constituting a supply of oxygen and integrated in an exhaust line of a motor vehicle diesel engine, in which the engine is associated with common rail means for feeding its cylinders with fuel, the system being characterized in that it comprises means for analyzing the running conditions of the vehicle and for comparing them with predetermined threshold values, to control the engine in a first regeneration mode of operation with a lean mixture when running conditions are above the threshold values, or in a second regeneration operating mode implementing sequences in which engine operation alternates between stages of rich mixture operation and of lean mixture operation when conditions are below the threshold values.

According to other characteristics:

- the depollution means comprise a particle filter;
- the particle filter includes a catalysts;
- the depollution means comprise a nitrogen oxide (NOx) trap;
- the fuel includes an additive that is to be deposited together with the particles with which it is mixed on the depollution means in order to facilitate regeneration thereof;
- the depollution means are impregnated with a selective catalytic reduction (SCR) formulation, performing a function of oxidizing CO/HC;

- the engine is associated with a turbocharger; and
- the running conditions are determined from:
  - the load on the engine;
  - its running speed;
  - the speed of the vehicle; and/or
  - the temperature level in the vehicle exhaust line.

Figure 2:
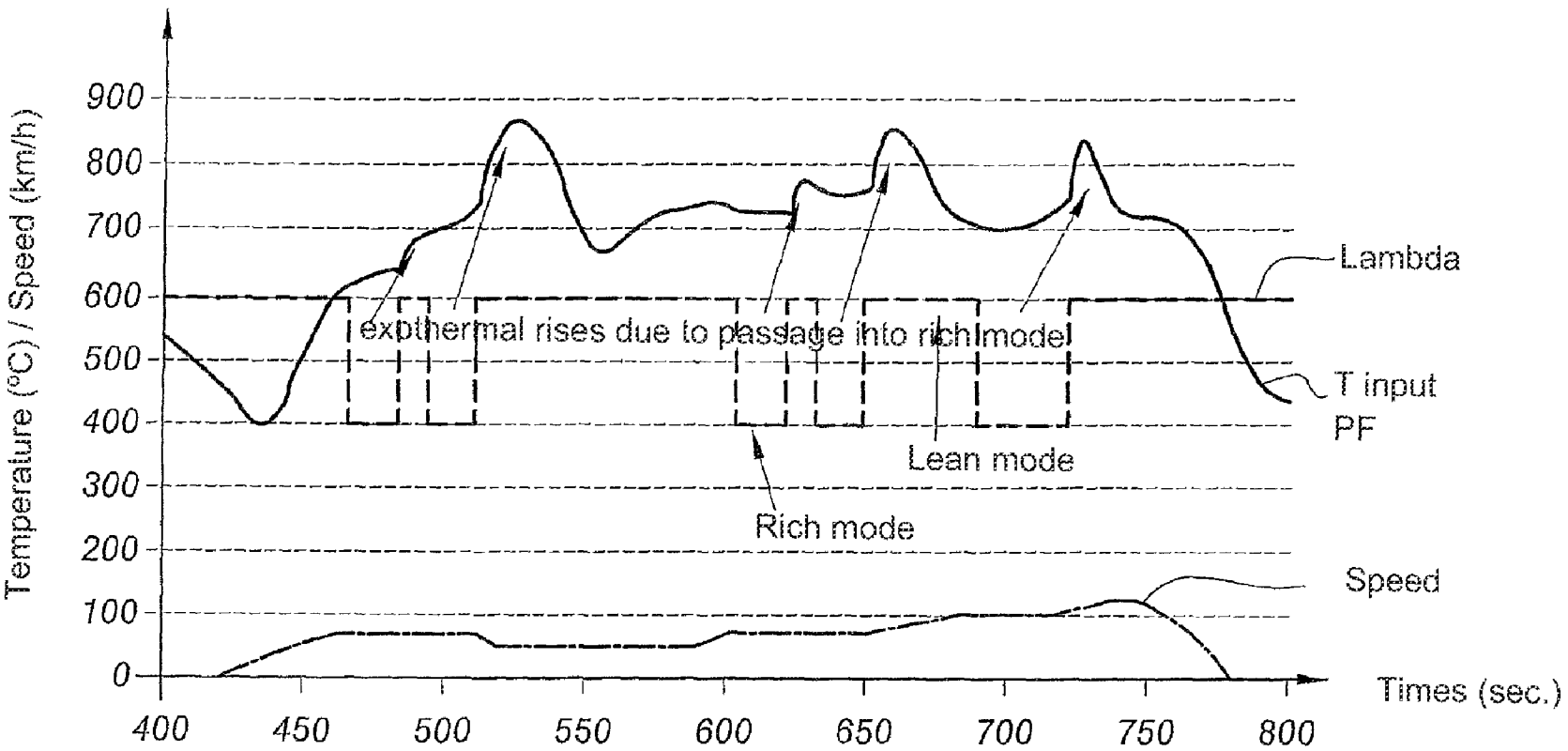

The invention can be better understood on reading the following description given purely by way of example and made with reference to the accompanying drawings, in which;

FIG. 1 is a block diagram showing the structure of a system for providing assistance in accordance with the invention; and FIG. 2 illustrates the operation thereof.

FIG. 1 shows a system for assisting the regeneration of depollution means given overall reference 1, and associated with oxidation catalyst-forming means that implement an OSC function, constituting a supply of oxygen and given overall reference 2, these means being placed in an exhaust line 3 of a motor vehicle engine.

The engine is given overall reference 4 and may be associated with a turbocharger, for example, having a turbine portion 5 associated with the exhaust line and a compressor portion 6 placed upstream from the engine.

Such oxidation catalyst-forming means implementing an OSC function are already known in the state of the art.

The engine is associated with common rail means for feeding its cylinders with fuel and given overall reference 7, with the operation thereof being under the control of a supervisor 8.

In the invention, the system also includes means for analyzing the running conditions of the vehicle and means for comparing said conditions with predetermined threshold values in order to control the operation of the engine.

The analysis means, e.g. formed by the supervisor 8, are then connected to means for acquiring said running conditions, given overall reference 9, delivering them to the supervisor 8 in such a manner as to enable it to compare them with threshold values as delivered by generator means 10 comprising any suitable means for establishing said threshold value.

By way of example, these running conditions can be determined on the basis of the load on the engine, its speed of rotation, the speed of the vehicle, and/or the temperature level in the vehicle exhaust line.

As a function of the result of this comparison, the supervisor and the common rail means for feeding fuel are adapted to cause the engine to operate in a first regeneration mode of operation using a lean mixture under running conditions above the threshold values, or in a second regeneration mode of operation implementing engine operating sequences comprising an alternation of stages of operating with a rich mixture and stages of operating with a lean mixture, when running conditions are below the threshold values. These rich or lean mixture operating stages are determined in conventional manner by modifying the parameters controlling the operation of the engine.

These strategies are designated respectively by overall references 11 and 12 in the figure.

This is shown in FIG. 2 in which there can clearly be seen the exothermal temperature rises associated with switching the engine into its rich mode of operation.

In rich mode, a diesel engine emits a large quantity of carbon monoxide (CO) and of unburned hydrocarbons in the exhaust gas.

Furthermore, the quantity of oxygen present in the gas is greatly reduced (to less than 2% to 3%, and sometimes to less than 1%). When this gas passes through the oxidation catalyst-forming means, it enables the CO and the HCs to be burnt using the oxygen present in the gas.

In order to be able to convert a larger quantity of CO and of HCs, it is desirable to make a larger quantity of oxygen available.

For this purpose, the presence of the OSC type component constituting a supply of oxygen, e.g. such as cerium which stores oxygen in the form of ceria CeO, and a composite oxide of cerium and zirconium in the oxidation catalyst-forming means, enables oxygen to be released when the engine passes into rich mode.

The combustion of CO and of HCs is an exothermal reaction that enables temperature levels at the outlet from the oxidation catalyst-forming means to be raised, i.e. at the inlet to the particle filter.

When the engine is operating in lean mode (particle filter regenerate mode), the amounts of reducing agents (CO, HCs) are much less than when operating in rich mode, but in rich mode, in spite of a smaller oxygen content, compensated in part by the presence of the OSC component, the heat produced exothermally by the oxidation catalyst-forming means is greater than when regenerating the particle filter in lean mode.

Switching to operation in rich mode thus enables the exhaust gas to be heated to a higher temperature, thus accelerating the rate at which the particle filter is regenerated.

For a particle filter using an additive to assist regeneration, the increase in temperature levels makes it possible to reduce the quantity of additive involved and thus to increase the distance the vehicle can travel prior to cleaning the filter.

It is known that such an additive can be mixed with the fuel fed to the engine in order to become deposited on the particle filter together with the particles with which it is mixed, in order to lower the combustion temperature of the soot trapped in the filter.

Conventionally, the additive is present in the particles after the additive-containing fuel has been burned in the engine.

Naturally, various embodiments can be envisaged.

Thus, for example, the depollution means may comprise a particle filter, optionally including a catalyst, a NOx trap, etc.

The depollution means may also be impregnated with an SCR formulation performing a function of oxidizing CO/HC in conventional manner.

Furthermore, the depollution means and the oxidation catalyst-forming means can be impregnated in a single element, in particular on the same substrate.

By way of example, a particle filter integrating the oxidation function could be envisaged.

Similarly, a NOx trap integrating such an oxidation function could also be envisaged, with or without additive.

This oxidation function and/or NOx trap function can be performed, for example, by an additive mixed in with the fuel.

As can be seen in FIG. 2, it can then be understood that the way the engine is controlled serves to increase temperature levels compared with standard operation, in particular under critical running conditions, thus enabling the filter to be regenerated more quickly.

The invention claimed is:

1. A method of assisting the regeneration of a depollution device by $O_2$ combustion of soot, wherein the depollution device is associated with an oxidation catalyst implementing an OSC function, constituting a supply of $O_2$ and integrated in an exhaust line of a motor vehicle diesel engine, in which the oxidation catalyst constituting a supply of $O_2$ is located upstream of the depollution device and the engine is associated with a common rail for feeding its cylinders with fuel, the method comprising:

analyzing the running conditions of the vehicle, and comparing them with predetermined threshold values including a threshold value of a temperature level in the vehicle exhaust line, and controlling the engine in a first regeneration operation mode by molecular $O_2$ combustion of the soot with a lean mixture when running conditions are above the threshold values, or in a second regeneration operating mode by molecular $O_2$ combustion of the soot implementing sequences in which engine operation alternates between stages of rich mixture operation and of lean mixture operation as long as conditions are below the threshold values including the temperature threshold value, to raise the temperature level in the vehicle exhaust line as long as the temperature is under the temperature threshold value, so that during rich mode, oxygen is released from the oxidation catalyst to promote combustion of reducing agents, so as to raise temperature levels at an inlet to the depollution device.

2. A method according to claim 1, wherein the depollution device comprises a NOx trap.

3. A method according to claim 1, wherein the fuel includes an additive that is to be deposited together with the particles with which it is mixed on the depollution device in order to facilitate regeneration thereof.

4. A method according to claim 1, wherein the depollution device is impregnated with an SCR formulation, performing a function of oxidizing CO/HC.

5. A method according to claim 1, wherein the running conditions are determined from:

the load on the engine;

its running speed; and the speed of the vehicle.

6. A method according to claim 1, wherein the oxidation catalyst-forming means implementing an OSC function constituting a supply of $O_2$ stores oxygen in the form of at least one of ceria $CeO_2$ and a composite oxide of cerium and zirconium.

7. A method according to claim 1, wherein, in the second regeneration operating mode the alternating stages of rich mixture operation and of lean mixture operation include at least a first stage of rich mixture operation, followed by a second stage of lean mixture operation, followed by a third stage of rich mixture operation, wherein the rich mixture operation stages have approximately a same duration.

8. A method according to claim 1, wherein an outlet of the oxidation catalyst-forming means feeds into an inlet of the depollution device in the exhaust line.

9. A method according to claim 1, wherein the depollution device comprises a particle filter.

10. A method according to claim 9, wherein the particle filter includes a catalyst.

11. A system for assisting the regeneration of depollution means by $O_2$ combustion of soot, wherein the depollution means is associated with oxidation catalyst-forming means implementing an OSC function, constituting a supply of $O_2$ and integrated in an exhaust line of a motor vehicle diesel engine, in which the oxidation catalyst-forming means constituting a supply of $O_2$ is located upstream of the depollution means and the engine is associated with common rail means for feeding its cylinders with fuel, the system comprising means for analyzing the running conditions of the vehicle, for comparing them with predetermined threshold values including a threshold value of a temperature level in the vehicle exhaust line, and for controlling the engine (i) in a first regeneration operating mode by molecular $O_2$ combustion of the soot with a lean mixture when running conditions are above the threshold values, and (ii) in a second regeneration operating mode by molecular $O_2$ combustion of the soot implementing sequences in which engine operation alternates between stages of rich mixture operation and of lean mixture operation as long as conditions are below the threshold values including the temperature threshold value, to raise the temperature level in the vehicle exhaust line as long as the temperature is under the temperature threshold value, so that during rich mode, oxygen is released from the oxidation catalyst-forming means to promote combustion of reducing agents, so as to raise temperature levels at an inlet to the depollution means.

12. A system according to claim 11, wherein the depollution means comprise a NOx trap.

13. A system according to claim 11, wherein the fuel includes an additive that is to be deposited together with the particles with which it is mixed on the depollution means in order to facilitate regeneration thereof.

14. A system according to claim 11, wherein the depollution means are impregnated with an SCR formulation, performing a function of oxidizing CO/HC.

15. A system according to claim 11, wherein the running conditions are determined from at least one of:

the load on the engine;

its running speed; and the speed of the vehicle.

16. A system according to claim 11, wherein the oxidation catalyst-forming means implementing an OSC function constituting a supply of $O_2$ stores oxygen in the form of at least one of ceria $CeO_2$ and a composite oxide of cerium and zirconium.

17. A system according to claim 11, wherein, in the second regeneration operating mode, the alternating stages of rich mixture operation and of lean mixture operation include at least a first stage of rich mixture operation, followed by a second stage of lean mixture operation, followed by a third stage of rich mixture operation, wherein the rich mixture operation stages have approximately a same duration.

18. A system according to claim 11, wherein an outlet of the oxidation catalyst-forming means feeds into an inlet of the depollution device in the exhaust line.

19. A system according to claim 11, wherein the depollution means comprise a particle filter.

20. A system according to claim 19, wherein the particle filter includes a catalyst.

* * * * *